US005943846A

United States Patent [19]

Pollock

[11] Patent Number: 5,943,846

[45] Date of Patent: Aug. 31, 1999

[54] BULK PARTICULATE PACKAGING SYSTEM

[76] Inventor: John Pollock, 24432 Pressonville Rd., Wellsville, Kans. 66092

[21] Appl. No.: 08/907,108

[22] Filed: Aug. 6, 1997

[51] Int. Cl.[6] ..... B65B 63/02

[52] U.S. Cl. ..... 53/529; 53/228; 53/586; 100/218

[58] Field of Search ..... 100/127, 229 R, 100/218, 251; 53/529, 530, 586, 228

[56] References Cited

U.S. PATENT DOCUMENTS

| | | | |
|---|---|---|---|
| Re. 31,944 | 7/1985 | Stromberg | 53/529 X |
| 3,117,513 | 1/1964 | Burnett et al. | 53/529 |
| 3,327,449 | 6/1967 | Hullhorst et al. | 53/529 X |
| 3,377,945 | 4/1968 | Davis | 100/127 |
| 3,824,758 | 7/1974 | Hart et al. | 100/218 X |
| 3,832,822 | 9/1974 | Sherman . | |
| 4,396,835 | 8/1983 | Seragnoli . | |
| 5,046,258 | 9/1991 | Cahill et al. | 53/228 X |
| 5,058,634 | 10/1991 | Tisma . | |
| 5,125,210 | 6/1992 | Lang et al. | 53/529 |
| 5,226,269 | 7/1993 | Stoltenberg . | |
| 5,402,906 | 4/1995 | Brown et al. . | |
| 5,694,742 | 12/1997 | Elliott et al. | 100/218 X |

*Primary Examiner*—Linda Johnson
*Attorney, Agent, or Firm*—Chase & Yakimo, L.C.

[57] ABSTRACT

A system for forming and packaging a bulk of loose particulate material. The system utilizes a compression tower for initial deposit of the loose particular material therein with the bottom floor of said tower being presented by a belt of a conveyor system. A ram within the tower compresses the loose material into a bulk form atop the conveyor belt. Subsequent to compression, the conveyor system is vertically displaced so that the formed material bulk can be conveyed to an horizontally adjacent conveyor for downstream conveyance to a space formed between downstream upper and lower conveyor assemblies. A sheet of packaging material spans the upper and lower conveyor assemblies such that the material bulk is directed through the sheet and enveloped thereby. The system diminishes the dislodgement of the particulate material from the bulk subsequent to its formation and transports and avoids the expenses of utilizing separately formed packaging bags.

10 Claims, 10 Drawing Sheets

BULK PARTICULATE PACKAGING SYSTEM

BACKGROUND OF THE INVENTION

This invention pertains to a packaging system and more particularly to a system for forming particulate material into a desired bulk shape and packaging the material bulk with minimal material loss and/or fibrous lumps.

Various devices have been proposed for shaping and packaging particulate matter into a bulk form. Certain devices first compress the material into a bulk form and then ram-direct the bulk into a preformed plastic bag. One problem with these devices is that the movement of the material bulk from one station to the other dislodges portions of the material from the previously shaped bulk, particularly at the corners thereof. This material separation can occur during ram induced transport particularly when directed through a downstream chamber such that friction arises. The resulting friction dislodges particulates from the material bulk, particularly at the corners thereof as well as forms fibrous lumps of material. The latter condition occurs as the friction directs the particulate matter in a direction opposite the direction of travel of the material bulk. Such actions cause an uneven material bulk, which precludes easy palletization, and unnecessary waste of the particulate material.

Another problem is that the material bulk had to be deposited in a bag which requires additional bag production, material and labor costs and possible particulate dislodgment during bagging.

SUMMARY OF THE INVENTION

In response thereto, I have invented a particulate packaging system which comprises a first vertical compression tower for shaping the particulate matter into a bulk-like form. The compression tower includes an internal ram which compresses the loose particulate material into a bulk form at the bottom of the tower. The bottom floor of the tower is presented by a conveyor belt, this conveyor belt with the formed material bulk thereon being vertically displaced from the tower proper. Upon separation of the material bulk from the tower, the underlying conveyor belt directs the bulk into a horizontally adjacent conveyor system which includes vertically spaced apart upper and lower conveyor belts. Spanning the space between the upper and lower conveyor belts is a sheet of packaging material. The material bulk is conveyed through this packaging sheet so that the sheet envelopes the material bulk for conveyance to a downstream shrink wrap station. The use of the conveyor systems precludes the need to slide the material bulk and diminishes, if not precludes, the above discussed problems.

It is accordingly a general object of this invention to provide a novel, efficient particulate bulk forming and packaging system.

Another object of this invention is to provide a system, as aforesaid, utilizing a particulate compression tower and a reciprocative conveyor belt associated therewith.

A still further object of this invention is to provide a system, as aforesaid, wherein the conveyor belt horizontally directs a shaped material bulk for downstream conveyance through a vertical sheet of packaging material.

A further object of this invention is to provide a system, as aforesaid, wherein the sheet of packaging material spans upper and lower spaced conveyor belts, these belts directing the material bulk through the packaging sheet.

Another object of this invention is to provide a system, as aforesaid, which diminishes the separation of the particulate material from the material bulk mass.

A particular object of this invention is to provide a system, as aforesaid, which diminishes the production of fibrous lumps in the material bulk.

A further particular object of the invention is to provide a system, as aforesaid, wherein the height of the material bulk can be regulated thereby providing for packaging weight modifications without deviance from the optimize length and width requirements necessary for palletization.

A still further object of this invention is to provide a system, as aforesaid, which presents the material bulk for packaging in a shrink wrap material.

Another particular object of this invention is to provide a system, as aforesaid, wherein a ram induced movement of the material bulk is precluded.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
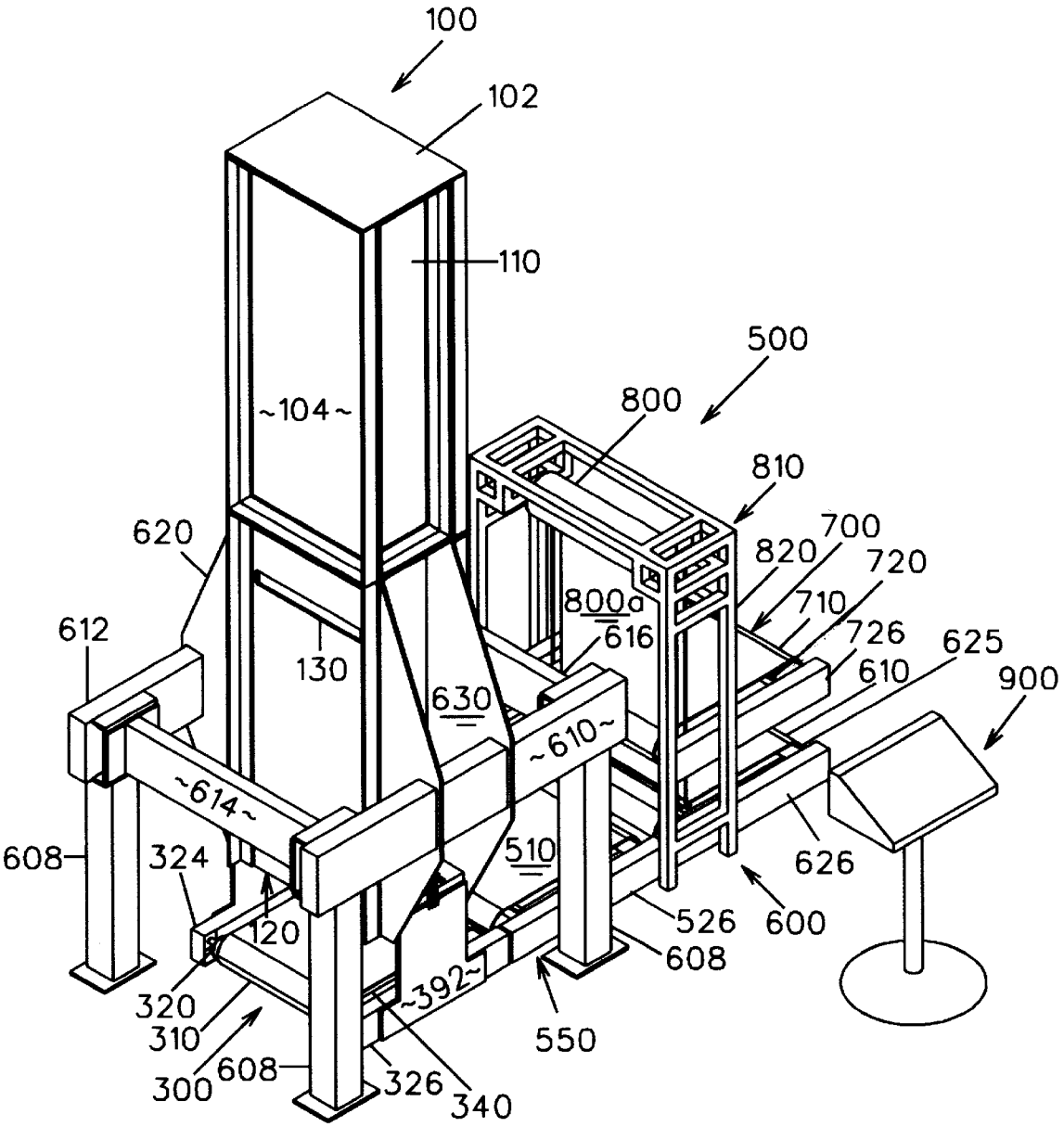
FIG. 1 is a perspective view of the system.
Figure 2:
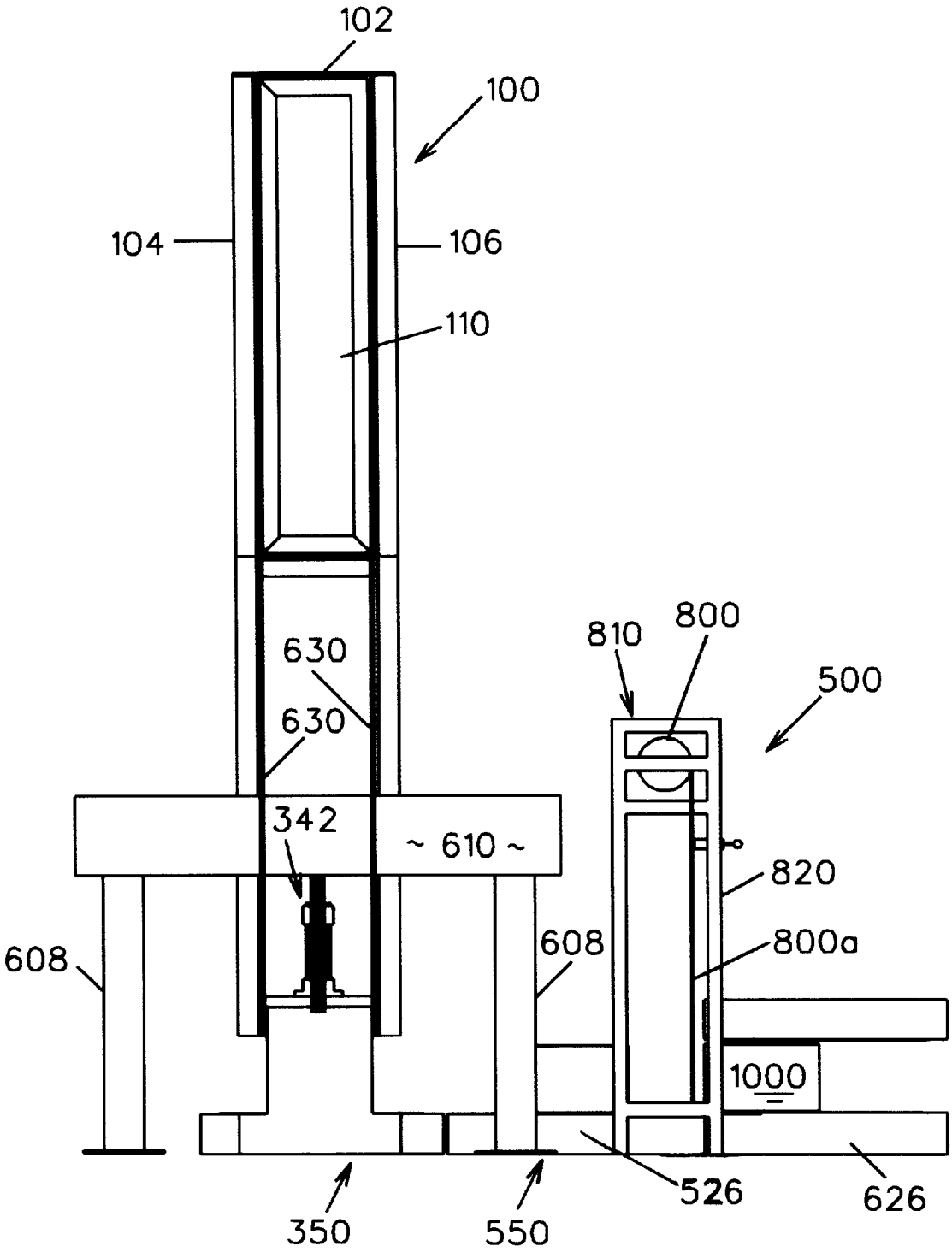
FIG. 2 is a side elevation view of the system in diagrammatic form.

Turning more particularly to the drawings, FIG. 1 shows the system as comprising a compression tower 100 for forming the loose particulate material into a bulk form 1000 and a downstream packaging station 500 for wrapping the resulting material bulk 1000 (FIG. 2) in a plastic wrap 800 or the like.

Figure 3:
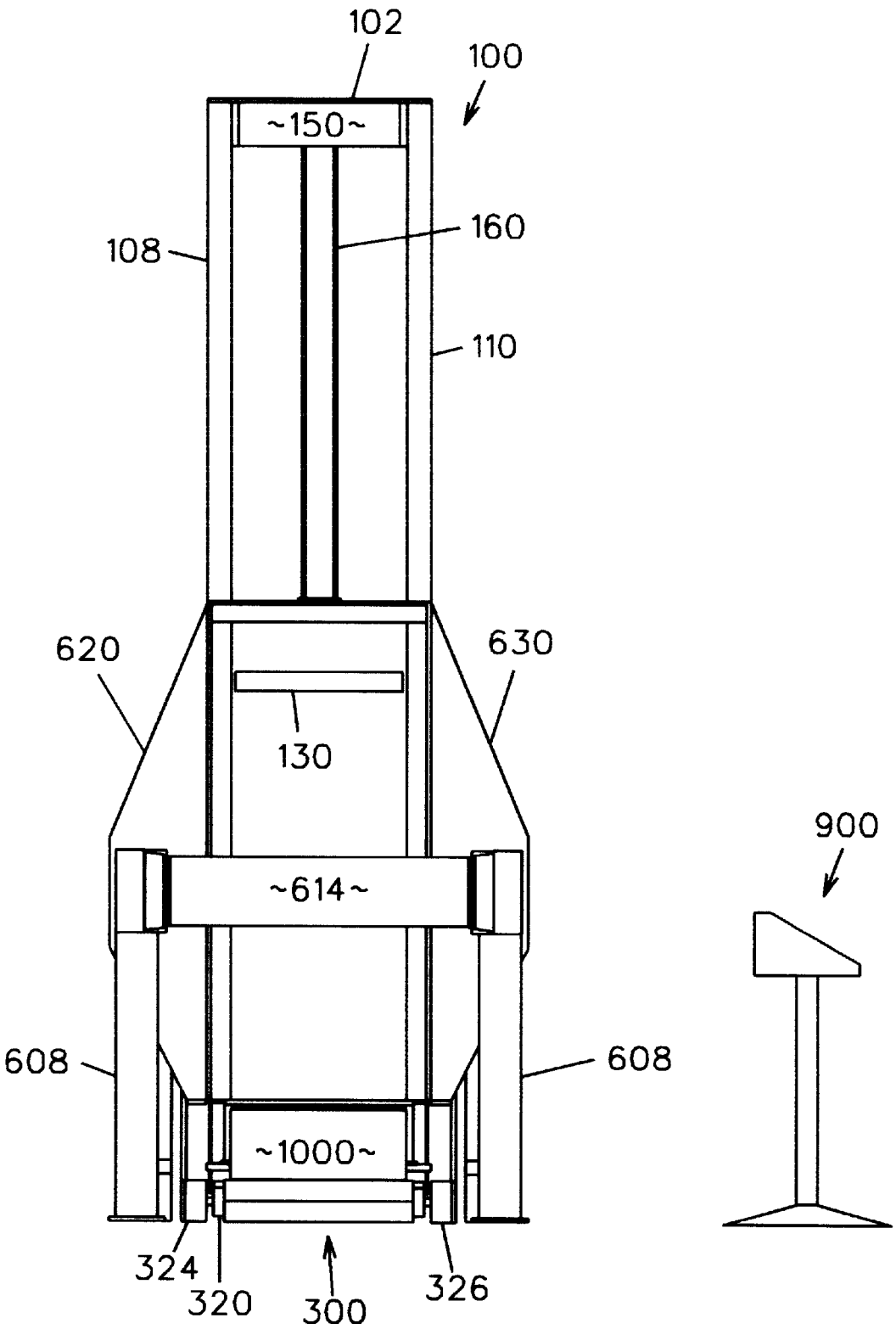
FIG. 3 is a left end view of the upstream end of the system of FIG. 1 in diagrammatic form.
Figure 4:
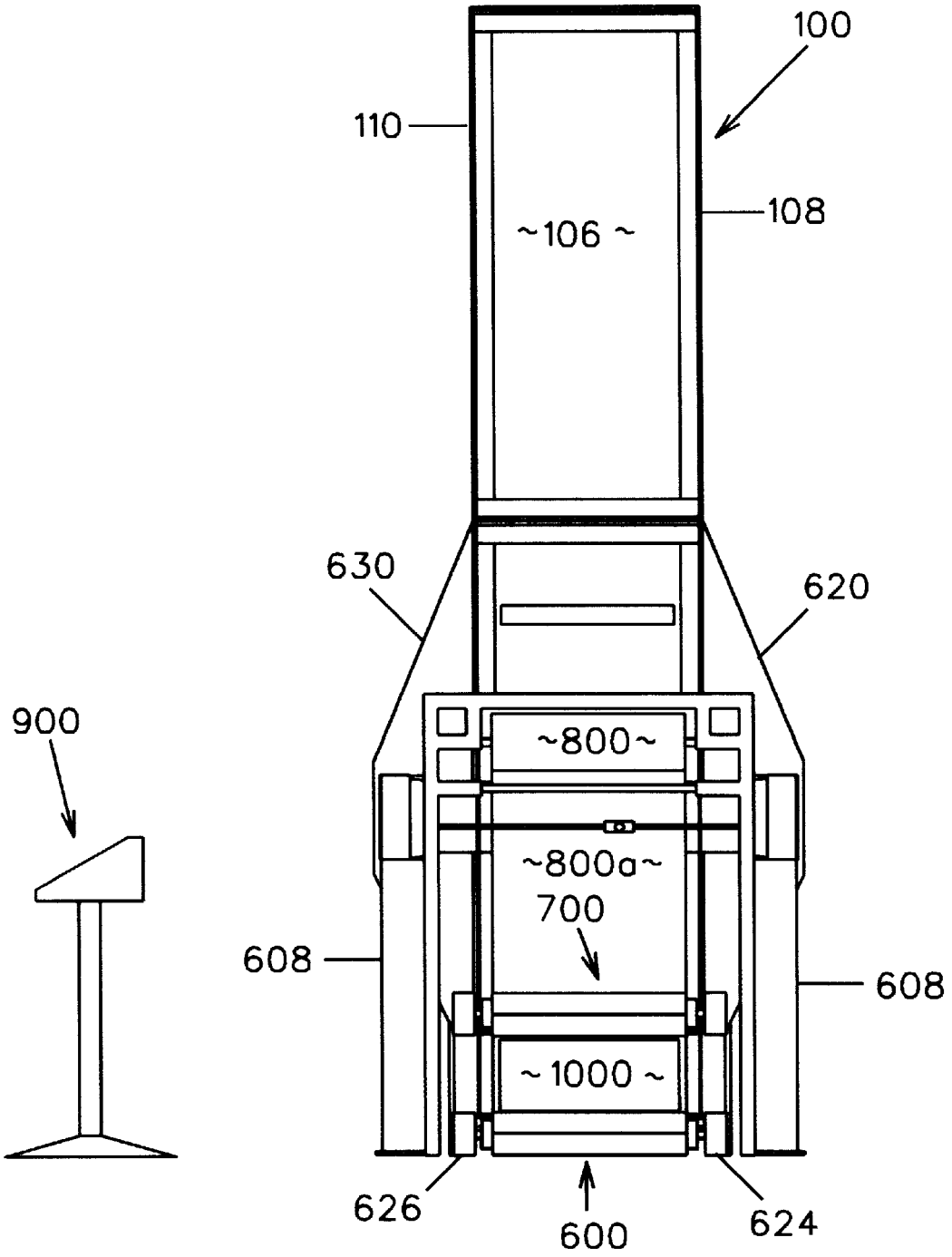
FIG. 4 is a right end view of the downstream end of the system of FIG. 2 in diagrammatic form.
Figure 5:
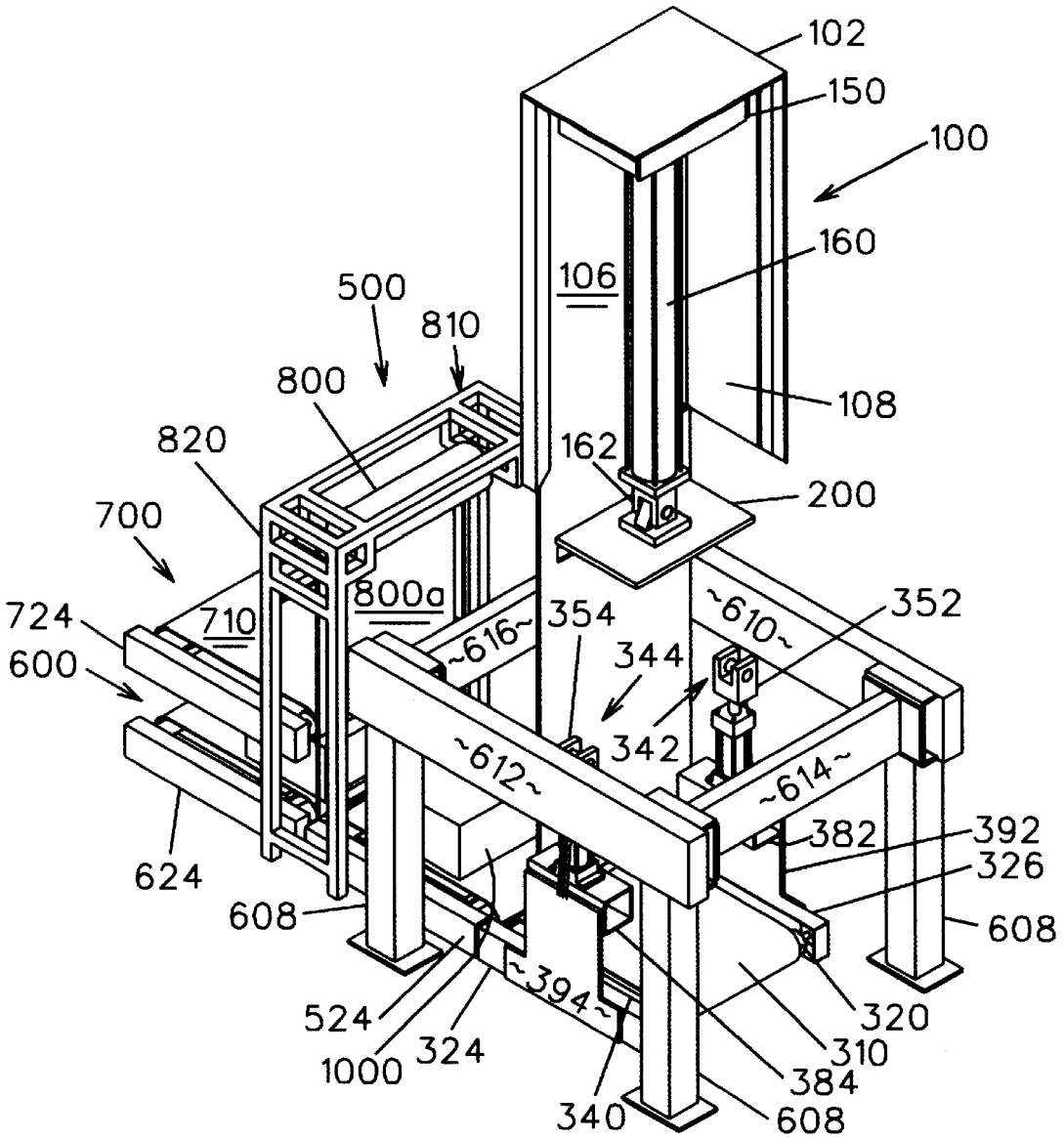
FIG. 5 is an opposed perspective view of the system of FIG. 1 with a portion of the side walls and one end wall of the compression tower being removed so as to show the interior thereof.
Figure 6:
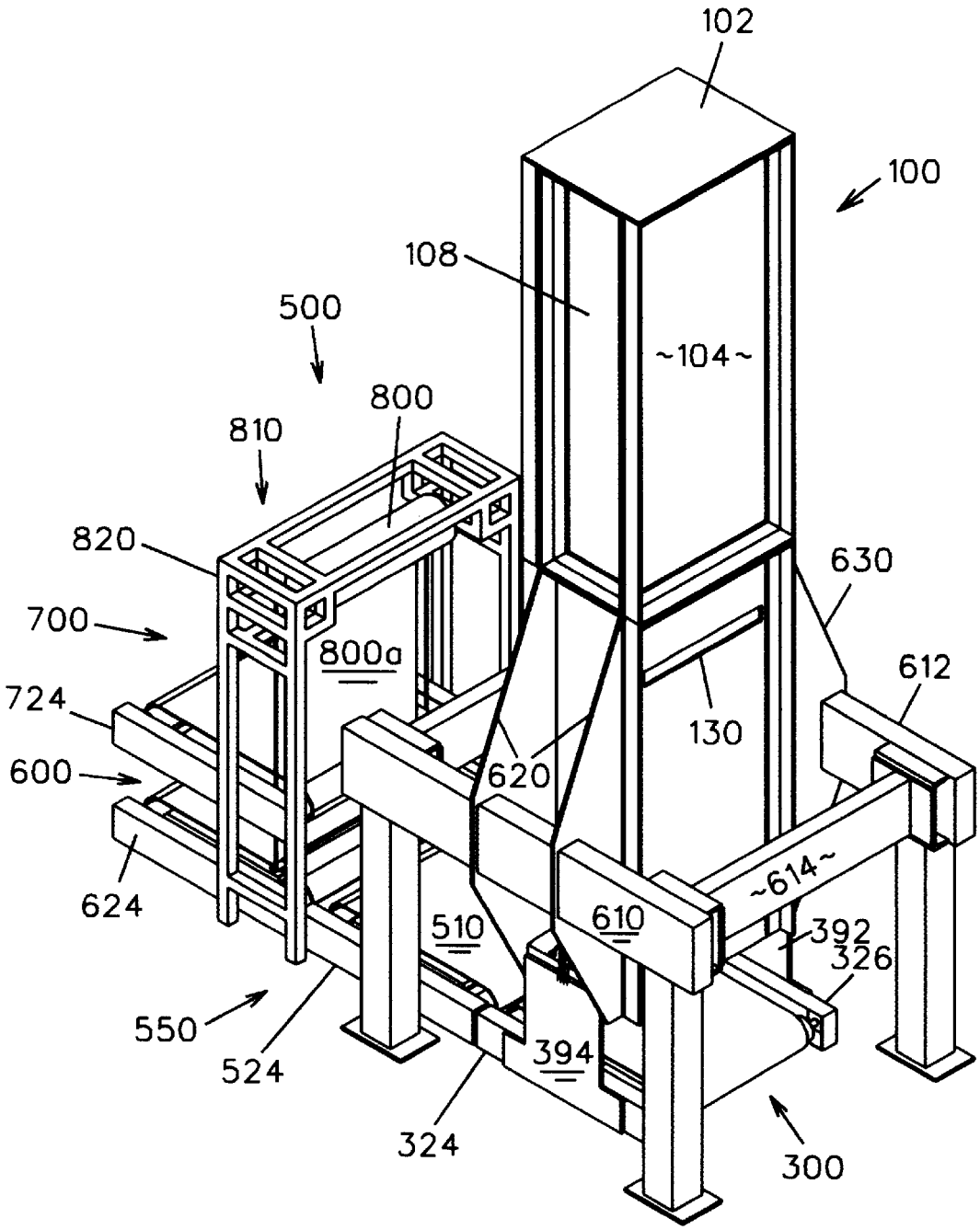
FIG. 6 is an opposed perspective view of the system of FIG. 5 with the walls of the compression tower in place.
Figure 9:
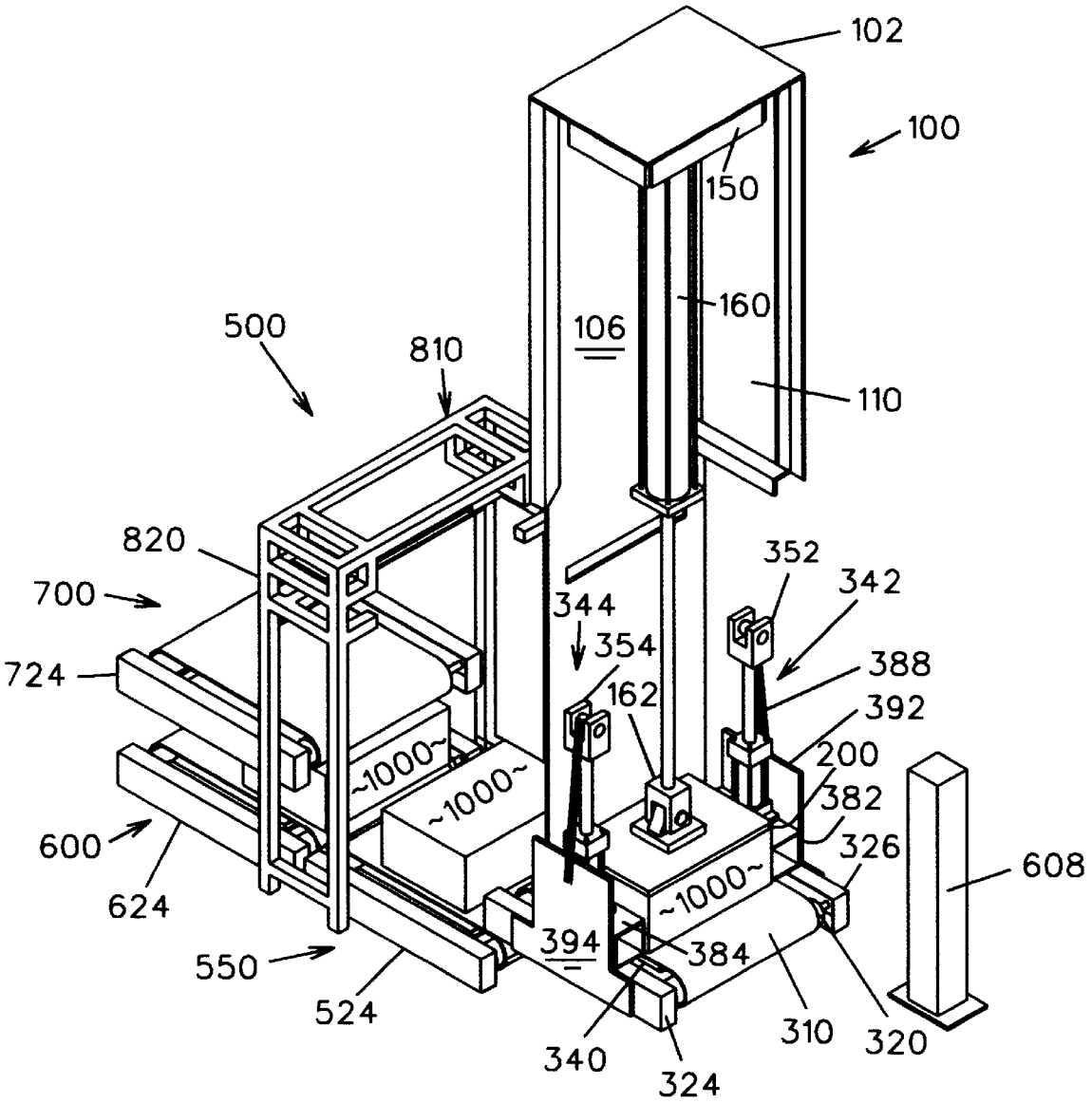
FIG. 9 is a perspective view of the system of FIG. 7 showing the compression ram in its functional position and a plurality of mutual bulks being conveyed by the system.
Figure 10:
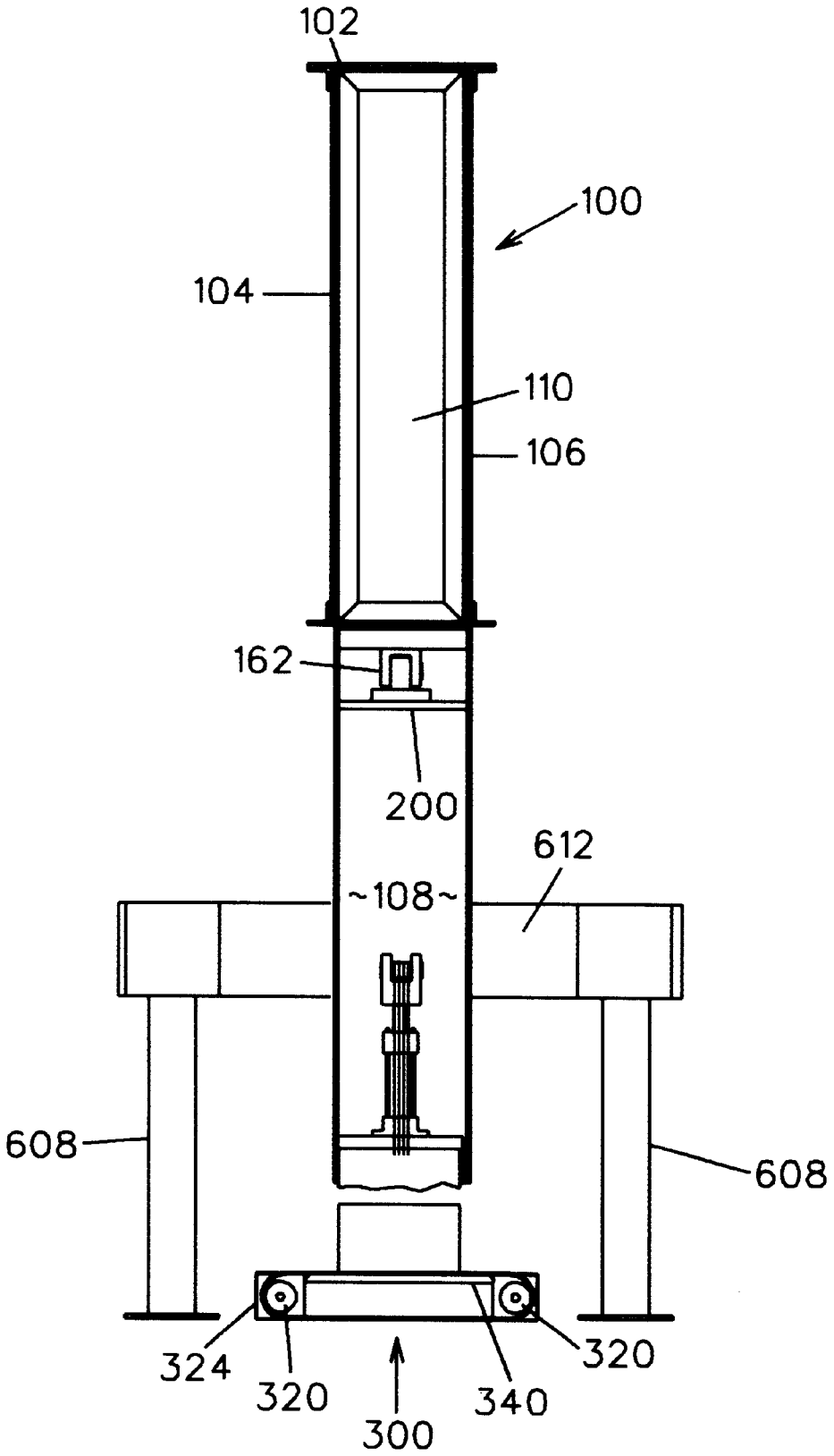
FIG. 10 is a side view of a system of FIG. 2 with a portion of the support frame work, conveyor mounting flanges and conveyor side wall removed.

The compression 100 tower comprises a top wall 102, vertical side walls 104, 106 and end walls 108, 110. Within the tower 100 is a mounting plate 150 adjacent the top wall 102 with a piston/cylinder combination 160 depending therefrom (FIG. 5). At the free bracketed end of the reciprocating piston rod 162 is attached a compression plate 200, the plate having a configuration generally congruent to the lower open end 120 of the tower 100. As shown, the piston rod 162 is reciprocatively extendable between a position in which the plate 200 is above the material inlet 130 (FIG. 3) and a second functional position adjacent the open bottom 120 of the tower (FIG. 9).

The tower 100 is supported by framework which comprises a plurality of vertical legs 608 with side cross struts 610, 612 and end struts 614, 616 extending therebetween and through support flanges 620, 630 extending from the sidewalls 108, 110 of the tower 100.

Figure 7:
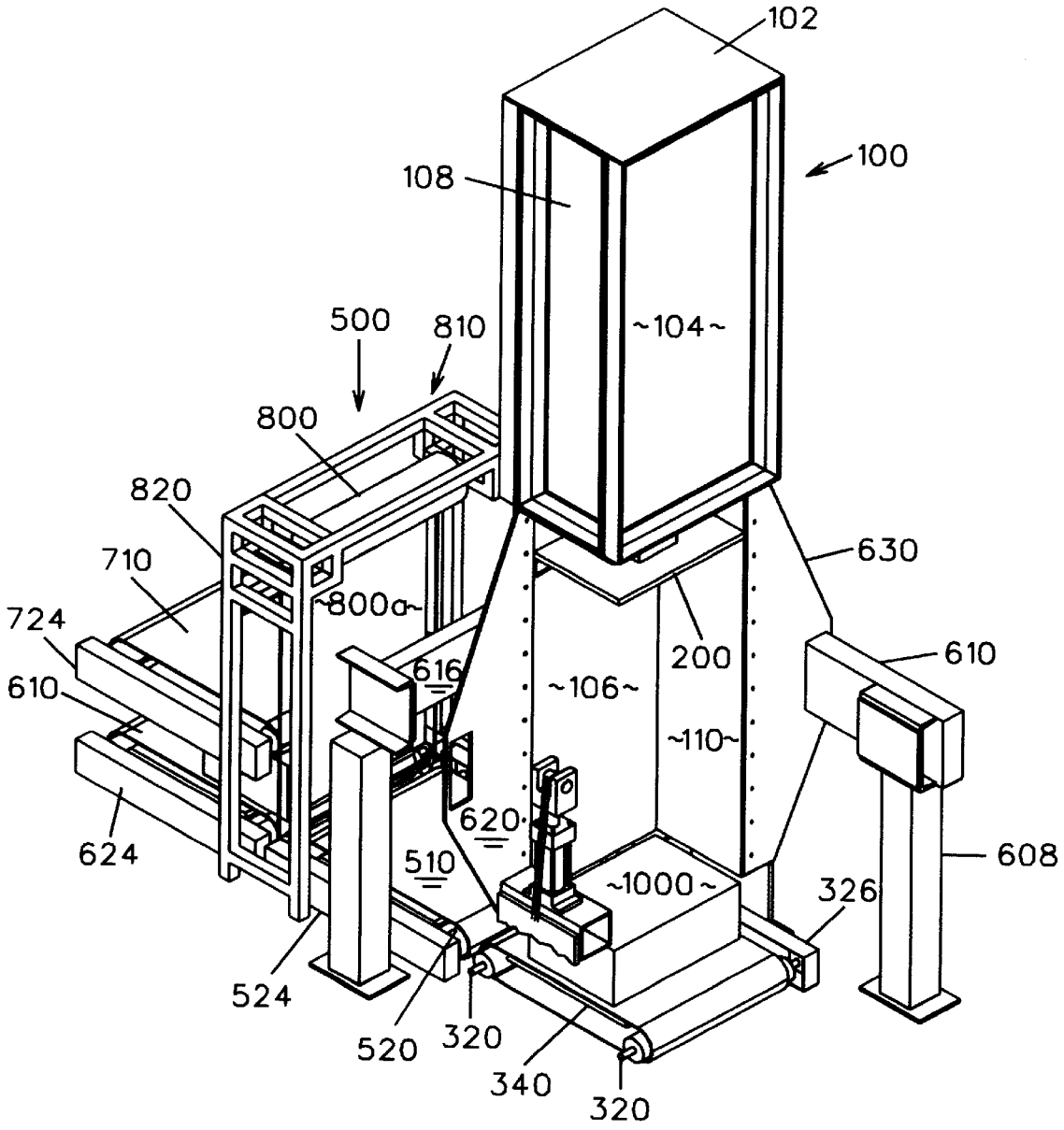
FIG. 7 is a view of the system of FIG. 6 with a portion of the support frame of the compression tower removed and showing a material bulk on the conveyor assembly underlying the compression tower.

Located below the bottom aperture 120 of the tower 100 is a first conveyor belt assembly 300 including a conveyor belt 310 mounted about rollers 320 extending between rails 324, 326. A support plate 340 (FIG. 7) underlies the top surface of the conveyor belt 310. Plate 340 is configured to approximate the lower open end 120 of the tower 100.

Figure 8:
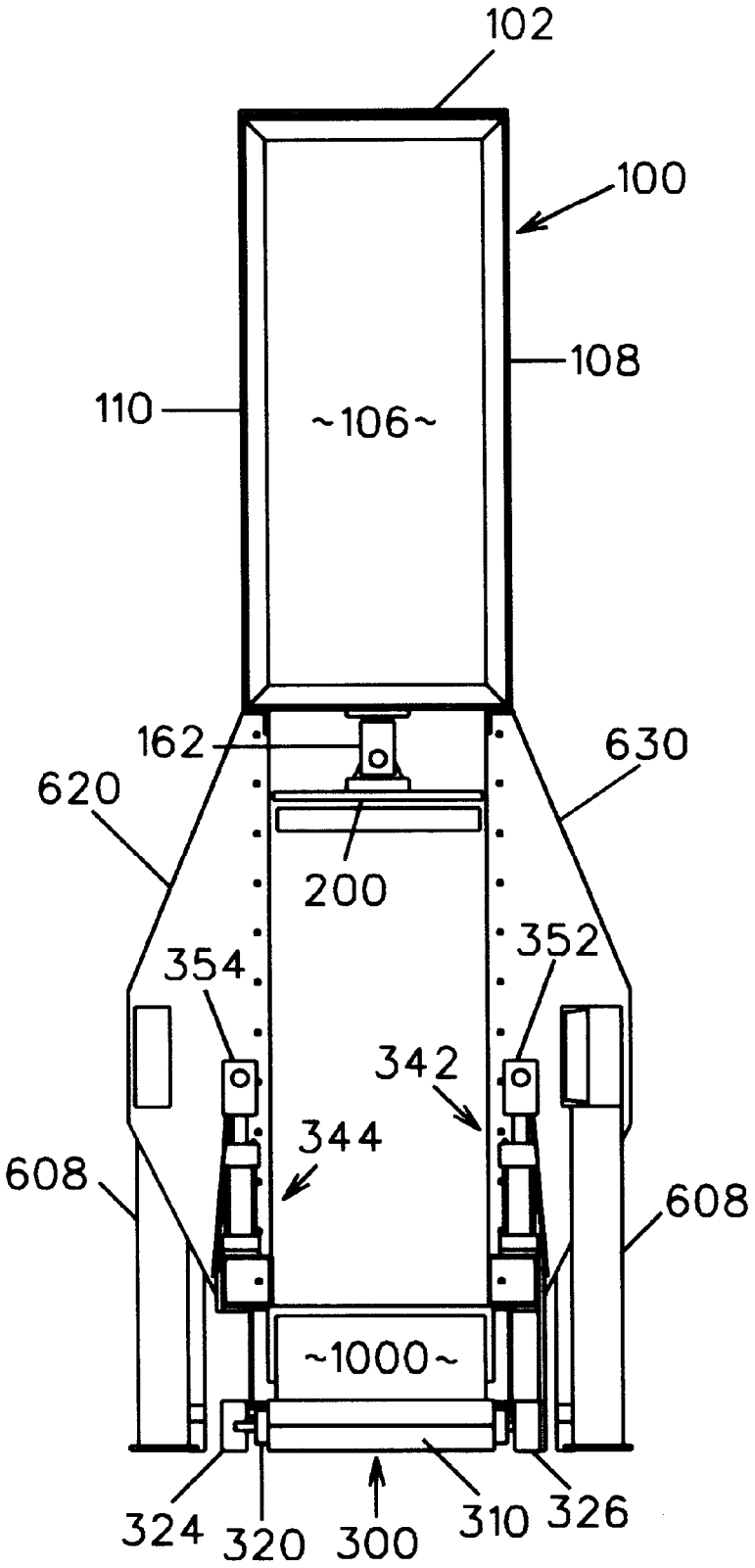
FIG. 8 is an end view of the system, as in FIG. 3, with a portion of the support frame and cylinder mounting flanges of the tower removed.

The first conveyor system 300 is movable between a first position in which the conveyor belt 310 and underlying plate 340 closes the bottom aperture 120 of the tower 100 and a second position vertically displaced from the tower. This movement is provided by first and second piston/cylinder combinations 342, 344 attached to brackets 352 and 354 which are connected to the flange walls 620, 630 of the tower (FIG. 8).

Attached to the lower end of each respective cylinder is a mounting flange 382, 384 to which depending mounting plates 392, 394 are attached (FIG. 9). These plates 392, 394 are attached to the rails 324, 326 of the conveyor assembly 300. Roller chains 380 extending between the respective brackets 352, 354 and plates 392, 394 provide further support. Accordingly, the conveyor system 300 can be reciprocated by operation at the piston/cylinder combinations 342, 344 between a first position in which the top surface of the conveyor belt 310 with plate 340 therein closes the tower aperture 120 and a second lower position displaced from the tower 100 as shown in the drawings.

Downstream from the tower 100 is the packaging station 500 which includes a conveyor belt assembly 550 horizontally adjacent the conveyor assembly 300 when the conveyor belt is at its second vertically displaced position relative to the tower 100. The conveyor system 550 includes a belt 510 mounted about rollers 520 extending between first and second laterally displaced apart rails 524, 526.

Horizontally adjacent conveyor assembly 550 is a lower conveyor belt system 600 having a belt 610 extending about rollers 625 which extend between rails 624, 626.

Framework 810 upwardly extends from rails 624, 626. Attached to this framework 810 is an upper conveyor assembly 700 which includes a belt 710 mounted about rollers 720 extending between rails 724, 726, the rails 724, 726 being mounted to support legs 820 of the frame 810. This upper conveyor 700 assembly is spaced from the lower assembly 600 such that the respective belts 610, 710 contact the bottom and top surfaces of bulk 1000 once positioned therebetween.

The packaging station frame 810 supports a bolt of packaging material 800 which presents a depending sheet 800*a* of packaging material spanning the space between the upper 700 and lower conveyor belt 600 assemblies. The packaging station includes a cutter 850 for cutting the package material.

It is understood that the various conveyor belt assemblies 300, 550, 600, 700 are powered in a conventional manner so as to convey and transfer materials therebetween. It is also understood that the extensions and retractions of the above-described piston/cylinder combinations 160, 342, 344 are also controlled in a conventional manner. As shown, these assemblies may be remotely controlled by use of station 900. Moreover, the unrolling of the package material from bolt 800 so as to present sheet 800*a* may also be automatically controlled.

In operation, the conveyor belt assembly 300 is positioned at its first position wherein the belt 310 and underlying plate 340 close the bottom aperture 120 of the tower 100. The loose particulate matter is deposited through aperture 130 and will fall to the bottom of the tower atop the belt 310. At this position the compression plate 200 is above the intake aperture 130 so as to preclude interference with the incoming particulate.

Upon a select amount of material being fed into the tower 100 the piston/cylinder combination is operated so as to move the compression plate 200 into a dwelling, tamping relationship atop the particulate matter. The compression presented by the combination of the compression and support plates 200, 340 and the surrounding tower walls forms a cube 1000 of the particulate material. It is understood that the amount of material deposited and the dwelling relationship of the compression plate 200, relative to the support plate 340, may be adjusted so as to regulate the height of bulk 1000. Subsequent to formation, the operation of the piston/cylinder combinations 342, 344, along with the downward pressure of plate 200, displaces the conveyor assembly 300 with bulk 1000 thereon to a position below the bottom of the tower. The conveyor belt 310, at this ground adjacent position, then transfers this material bulk 1000 to the subsequent conveyor 550 and then to the space between the upper and lower conveyor assemblies 600, 700.

During this latter transfer, the bulk 1000 passes through the conveyor assemblies 600, 700 and the spanning material sheet 800*a* so that the sheet envelops the material bulk, the slack in sheet 800 being such so as to enhance such envelopment, particularly along the bottom of bulk 1000. Moreover the contact of the conveyor belt, 610, 710 with the lower and upper surfaces of bulk 1000 further aids in bulk conveyance and sheet envelopment. Also, this conveyor belt 610, 710 contact precludes the compressed bulk 1000 from expansion towards its original non-compressed volume. Thus, the desired package height is maintained. The conveyor 600, 700 combination then conveys this bulk 1000, as enveloped by the packaging material, to a subsequent downstream station preferably a shrink wrap station. A subsequent span of sheet 800*a* may then be unrolled from the bolt 800 for enveloping the next bulk 1000 formed in tower 100.

I have found that the use of the vertical tower 100 presents a material bulk 1000 which is efficiently formed. The downstream conveyance of the material bulk 1000 by the above combination of conveyor assemblies precludes the need to ram induce the horizontal movement of the material bulk 1000. Thus, the elimination of frictional force diminishes, if not precludes, the separation of particulate matter from the material bulk 1000 and/or the formation of fibrous lumps therein. Moreover, the presentation of the material sheet 800*a* precludes the need to utilize separate bags and avoids the associated expenses thereof. Accordingly, elimination of the particulate material loss along with the cost effective use of packaging material presents an efficient system for the formation and packaging of particulate materials into a bulk form.

It is to be understood that while a certain form of this invention has been illustrated and described, it is not limited thereto except insofar as such limitations are included in the following claims and allowable functional equivalents thereof.

I claim:

1. A system for forming and packaging particulate material in a bulk form comprising:

a compression tower comprising:

a chamber presented by a series of walls;

a ram assembly in said chamber having a first position adjacent a top of said tower and selectably extendable to a second position adjacent a lower end of said tower;

an opening at said lower end of said tower;

first conveyor means including a generally horizontal conveyor belt having a surface for forming a base of said tower, said first conveyor means movable between a first position wherein said horizontal conveyor belt surface closes said opening and a second position wherein said first conveyor means and said belt is downwardly displaced from said opening of said tower, said first conveyor means operable to move said belt in a horizontal direction at said second position for a belt induced horizontal conveyance of material thereon beyond said tower;

an inlet in said tower for deposit of particulate material therein, said deposited material falling upon said first conveyor means belt surface at said first position, an extension of said ram to said second position compressing said material into a bulk form atop said first conveyor means surface at said first position, said bulk form being vertically displaced below said tower opening upon said movement of said first conveyor means to said second position for a subsequent horizontal conveyance;

a packaging system for said material bulk comprising:

a second conveyor means including a conveyor belt having a surface generally coplanar with and longitudinally displaced from said belt surface of said first conveyor means at said second position;

a third conveyor means including a conveyor belt having a surface vertically displaced from and generally parallel to said second conveyor means belt surface to present a space for receipt of said material bulk form therebetween;

a fourth conveyor means including a conveyor belt having a surface generally coplanar with said belt surfaces of said second conveyor means and said belt surface of said first conveyor means at said second position, said fourth conveyor means belt intermediate said first conveyor means at said second position and said second conveyor means for a generally horizontal conveyance of said bulk form received from said first conveyor means at said second position;

a sheet of packaging material for spanning said space between said second and third conveyor means, an operation of said conveyor belt of said first and fourth conveyor means urging said material bulk form from said belt surface of said first conveyor means onto said generally coplanar belt surface of said fourth conveyor means for movement towards said space between said second and third conveyor means, said belt surface of said third conveyor means contacting a top of said material bulk form with said belt surface of said second conveyor means contacting a bottom of said material bulk form, an operation of said second and third conveyor means horizontally directing said material bulk through said packaging material sheet for envelopment thereby, said material bulk with said packaging material thereon horizontally conveyed to a downstream location by movement of said belts of said respective conveyor means upon operation thereof.

2. The system as claimed in claim 1 wherein said ram assembly comprises:

a piston/cylinder assembly including a piston rod therein, said rod reciprocatively movable between a first retracted position relative to said cylinder and a second extended position relative to said cylinder;

means for mounting said piston/cylinder assembly to said tower;

a compression plate;

means for mounting said compression plate to said rod in said reciprocative movement, said second rod position moving said compression plate to said second position for said compression of said material.

3. The system as claimed in claim 1 wherein said first conveyor means further comprises:

a support plate underlying said first conveyor means belt surface;

means for moving said first conveyor belt surface between said first and second positions comprising:

at least one piston/cylinder assembly including a piston and rod;

means for mounting said at least one piston/cylinder assembly of said first conveyor means to said tower;

bracket means for connecting said first conveyor means to said at least one piston/cylinder assembly of said first conveyor means, said rod of said first conveyor piston/cylinder assembly reciprocatively movable between a first position wherein said first conveyor means belt surface and underlying support plate is moved to said first position for closing said lower tower opening and said second position displaced from said tower.

4. The system as claimed in claim 3 wherein said mounting means for said piston/cylinder combination of said first conveyor means comprises:

a pair of spaced apart flanges normally extending from a wall of said tower;

a bracket for mounting said at least one piston/cylinder combination of said first conveyor means between said flanges, said connecting bracket means movable between said flanges upon said movement of said first conveyor belt surface between said first and second positions.

5. A system for forming and packaging particulate material in a bulk form comprising:

a compression tower comprising:

a chamber presented by a series of walls;

a ram assembly in said chamber having a first position adjacent a top of said tower and selectably extendable to a second position adjacent a lower end of said tower;

an opening at said lower end of said tower;

first conveyor means presenting a conveyor surface for forming a floor of said tower; and means for moving said first conveyor means and floor surface between a first position wherein said floor surface closes said opening and a second position wherein said floor surface is displaced from said opening of said tower;

an inlet in said tower for deposit of particulate material therein, said deposited material falling upon said conveyor means floor surface at said first position, an extension of said ram to said second position compressing said material into a bulk form on said floor surface at said lower end of said tower, said bulk being displaced from said tower upon said movement of said first conveyor means floor surface to said second position;

second conveyor means including a belt surface coplanar with said floor surface of said first conveyor means at said second position for receiving said material bulk thereon from said first conveyor means floor surface for downstream conveyance;

a packaging system for said material bulk comprising:

a third conveyor means including a belt surface longitudinally adjacent and coplanar with said surface of second conveyor means;

a fourth conveyor means including a belt surface vertically displaced from said third conveyor means belt surface to present a space for reception of said material bulk therebetween;

a vertical sheet of packaging material between said third and fourth conveyor means, an operation of said first, second, third and fourth conveyor means moving said belt surfaces for transferring said material bulk from said first conveyor means floor surface to said second conveyor means surface for subsequent transfer to said space between said third and fourth conveyor means belt surfaces, said operation directing said material bulk through said packaging material sheet for envelopment thereby for conveyance to a downstream location.

6. The system as claimed in claim 5 wherein a movement of said first conveyor means floor surface from said first position to said second position displaces said formed material bulk below said chamber lower end.

7. The system as claimed in claim 6 wherein said first conveyor means floor surface comprises:

a conveyor assembly including a conveyor belt;

a support plate underlying a surface of said conveyor belt, said conveyor belt surface and support plate closing said lower end of said chamber upon said moving of said conveyor assembly to said first position by said moving means.

8. The system as claimed in claim 7 wherein an operation of said conveyor assembly at said second position horizontally transports said formed material bulk to a downstream location.

9. The system as claimed in claim 5 wherein said floor surface moving means comprises:

a piston/cylinder assembly having a rod reciprocatively, movable between a first retracted position relative to said cylinder and a second extended position relative to said cylinder;

means for connecting said first conveyor means to said piston rod;

means for mounting said piston/cylinder assembly to said chamber, said rod at said first position positioning said first conveyor means and floor surface at said first position with said rod at said second position moving said first conveyor means and floor surface to said second position.

10. The system as claimed in claim 5 wherein said ram assembly comprises:

a piston/cylinder assembly;

a plate connected to said piston of said piston/cylinder assembly for a reciprocative movement therewith, said plate tamping said particulate material at said second position.

* * * * *